US006666510B2

(12) United States Patent
Solomon

(10) Patent No.: US 6,666,510 B2
(45) Date of Patent: Dec. 23, 2003

(54) HIGHCHAIR COVER AND SUPPORT

(76) Inventor: Andrew Solomon, 43 Spector La., Plainview, NY (US) 11803

( * ) Notice: Subject to any disclaimer, the term of this patent is extended or adjusted under 35 U.S.C. 154(b) by 35 days.

(21) Appl. No.: 10/041,975

(22) Filed: Jan. 9, 2002

(65) Prior Publication Data

US 2003/0127889 A1 Jul. 10, 2003

(51) Int. Cl.[7] ..... A47C 31/00

(52) U.S. Cl. ..... 297/219.12; 297/228.1; 297/228.12; 297/284.5

(58) Field of Search ..... 297/219.1, 219.12, 297/228.1, 228.12, 284.5, 254, 228.13

(56) References Cited

U.S. PATENT DOCUMENTS 2,229,160 A * 1/1941 Wittcoff
2,908,766 A * 10/1959 Taylor
3,504,941 A 4/1970 Gerard ..... 297/219
4,232,898 A 11/1980 Bodrero ..... 297/219
5,533,787 A * 7/1996 Xiang
5,707,107 A * 1/1998 Melone
5,906,413 A * 5/1999 Yang
6,142,565 A * 11/2000 Reider
6,206,468 B1 * 3/2001 Brosnan et al.
6,224,152 B1 * 5/2001 Hughes et al.
6,299,248 B1 * 10/2001 Gennaro et al.

* cited by examiner

*Primary Examiner*—Laurie K. Cranmer
(74) *Attorney, Agent, or Firm*—Charles W. Chandler

(57) ABSTRACT

A highchair back support that fills the space behind a small child and the chair back. The back support comprises a seatback cover dimensioned to be slid over the back of a highchair, and a support cushion that is connected to the seatback cover and rests on the seatpad.

9 Claims, 2 Drawing Sheets

HIGHCHAIR COVER AND SUPPORT

TECHNICAL FIELD

The present invention relates generally to chair covers and supports, and, more specifically, to a highchair back support for supporting a child in an upright position and for preventing a child from sliding out of a highchair.

BACKGROUND ART

Highchairs are designed for a wide age range of children, from a young infant up to an age just before the child is old enough to sit on its own in a regular or booster chair. Younger children are often too small to sit in a highchair without additional back support to urge their bodies to the front of the highchair. Consequently, parents must often use a rolled-up towel, article of clothing or other cloth to position between the child and the seatback of the highchair.

Prior art seatback covers are designed either to protect the surface of the chair or to improve the aesthetic appearance of the chair. A laminated chair protector may be found by reference to U.S. Pat. No. 3,504,941 to Gerard. This design uses front and back panels of laminated paper to protect the finish of the chair in shipping, handling and/or storage.

The seatback cover in U.S. Pat. No. 4,232,898 to Bodrero uses front and back panels as well as side panels to conform to a vehicle-type seatback. However, in light of the present invention, the aforementioned designs are deficient in that they do not provide back support that fills the extra space left in a highchair occupied by a small child.

It is readily apparent that a new and improved highchair back support is needed that supports a child in an upright and upfront position and prevents the child from sliding therefrom. It is, therefore, to the provision of such an improvement that the present invention is directed.

BRIEF SUMMARY OF THE INVENTION

Briefly described, in a preferred embodiment, the present invention overcomes the above-mentioned disadvantages by providing a highchair back support that fills extra space left in a highchair when a small child sits therein and supports the back of the child to prevent the child from sliding. Generally, the present invention, in the preferred embodiment, comprises a seatback cover, which slides over the back of a highchair and a support cushion, which removably attaches to the seatback cover.

More specifically, the seatback cover comprises front and back panels, which are joined on three sides, leaving an opening at the bottom of the cover. The seatback cover is easily slid over the back of the highchair and secured into position via hook-and-loop fastener. Hook-and-loop fasteners are also attached to the support cushion, and mating hook-and-loop fasteners are attached to the sides of the seatback cover, thereby allowing the support cushion to be removably attached to the seatback cover.

In an alternate embodiment, a single sheet of material is used to construct the seatback cover. The sheet of material is folded to form front and back panels, the front and back panels are then joined along its edges, wherein the bottom of the seatback cover remains open so that the cover can be slid over the seatback of the highchair as described in the preferred embodiment. In another alternate embodiment, the cushion can be secured to the seatback cover using ties, buckles, straps or any other suitable attaching means.

A feature and advantage of the present invention is to provide a new and improved highchair back support that prevents a child from sliding from a highchair.

Another feature and advantage of the present invention is provide a new and improved highchair back support that is portable thus making it suitable for use at restaurants and other locations.

Another feature and advantage of the present invention is to provide a new and improved low cost highchair back support for young children.

These and other objects, features and advantages of the invention will become more apparent to one skilled in the art from the following description and claims when read in light of the accompanying drawings.

DETAILED DESCRIPTION OF THE PREFERRED AND ALTERNATE EMBODIMENTS

In describing the preferred embodiment of the present invention as illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

Figure 1:
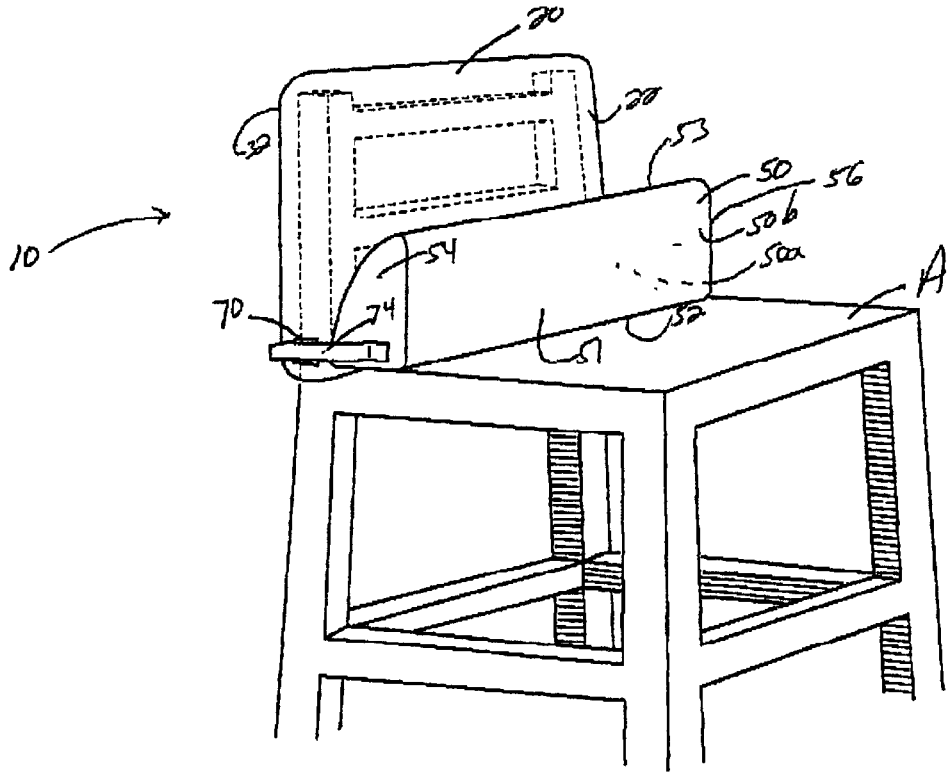
FIG. 1 is a perspective view of the present invention according to a preferred embodiment.
Figure 2:
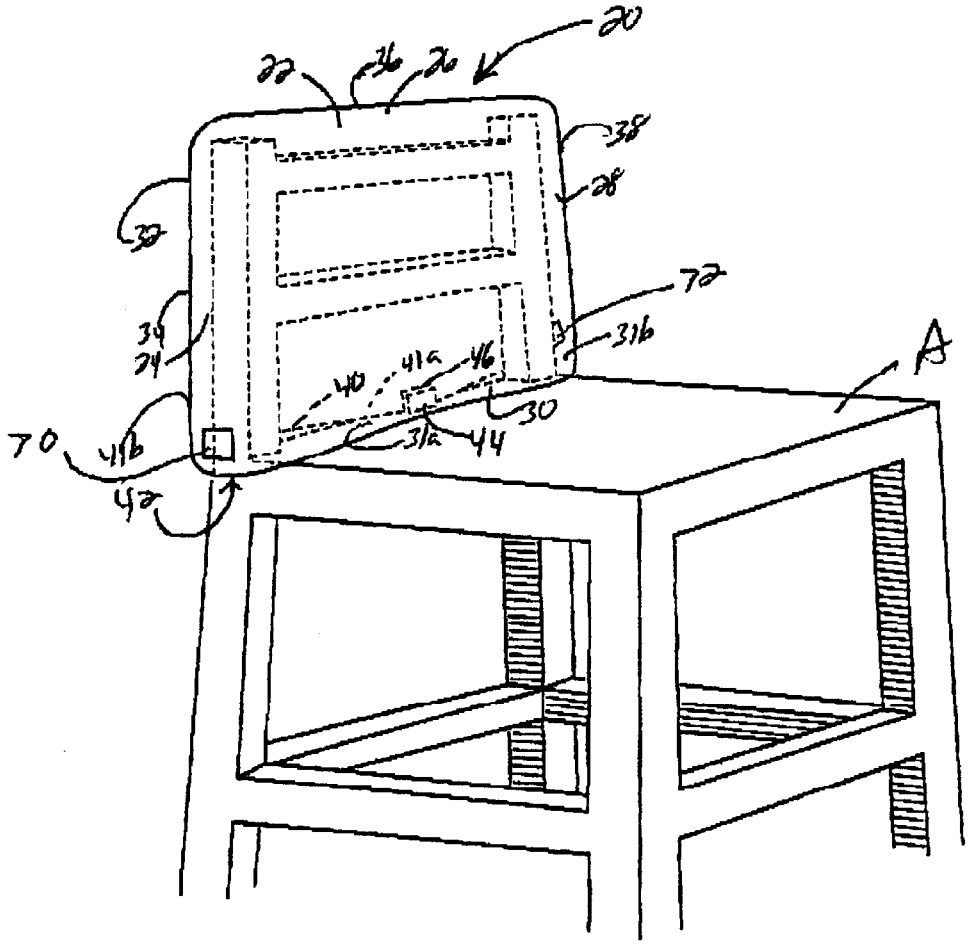
FIG. 2 is a perspective view of the seatback cover of the present invention according to a preferred embodiment.

Referring now to FIGS. 1 and 2, device 10 generally comprises seatback cover 20 and support cushion 50. More specifically, seatback cover 20 comprises front panel 22 and back panel 32. Front panel 22 and back panel 32 are constructed of a durable, non-stretchable fabric material cut to the approximate dimensions of a typical highchair A seatback configuration. Therefore, the width of front panel 22 and back panel 32 will approximate the width of the highchair A seatback.

Front panel 22 comprises first end 24, second end 26, third end 28, fourth end 30, inner surface 31*a* and outer surface 31*b*. Back panel 32 comprises first end 34, second end 36, third end 38, fourth end 40, inner surface 41*a* and outer surface 41*b*. Front panel 22 is fixedly attached to back panel 32 on three sides as more fully described below, preferably by stitching or any known means within the art. First end 24 of front panel 22 is fixedly attached to first end 34 of back panel 32. Second end 26 of front panel 22 is fixedly attached to second end 36 of back panel 32. Third end 28 of front panel 22 is fixedly attached to third end 38 of back panel 32.

Opening 42 is defined by fourth end 30 of front panel 22 and fourth end 40 of back panel 32. Seatback cover 20 is slid over the seatback of the highchair through opening 42 and is secured to the highchair by removably connecting fourth end 30 of front panel 22 and fourth end 40 of back panel 32 under the seatback of the highchair by any means known within the art such as, for exemplary purposes only, buttons, ties, buckles, hook-and-loop fastener or the like.

Preferably, first securing fastener 44 and second securing fastener 46 comprise hook-and-loop fasteners. First securing fastener 44 is fixedly attached to inner surface 31*a* of front panel 22 proximal to fourth end 30. Mating second securing fastener 46 is fixedly attached to inner surface 41*a* of back panel 32 proximal to fourth end 40. First securing fastener 44 and second securing fastener 46 are attached to first panel 22 and second panel 32, respectively, preferably by gluing, stitching or any known means within the art. First securing fastener 44 and second securing fastener 46 are preferably positioned directly across from and aligned with each other to allow seatback cover 20 to be secured under the seatback of highchair A.

First seatback fastener 70 and second seatback fastener 72 are provided for removably securing support cushion 50 to seatback cover 20. Preferably, first seatback fastener 70 and second seatback fastener 72 comprise one portion of hook-and-loop fastener, wherein the mating portion of hook-and-loop fastener is attached to support cushion 50 as more fully described below. First seatback fastener 70 and second seatback fastener 72 are fixedly attached to outer surface 41*b* of back panel 32 proximal to first end 24 and third end 28, respectively, by glue, stitching or any known means within the art.

Support cushion 50 is preferably an elongated triangular cross-sectional shaped member comprising insert 50*a* and cover 50*b* having first surface 51, second surface 52, third surface 53, first end 54 and second end 56. Insert 50*a* is preferably foam but may be formed from any suitable material known within the art. Surfaces 51, 52, 53, and ends 54 and 56 are constructed, preferably, of fabric material cut to the approximate dimensions of a typical highchair A seatback configuration. Therefore, the width of surfaces 51, 52, and 53 approximates the width of the highchair A seatback. The height of surface 51 will preferably approximate one-third to one-half the height of the highchair A seatback. In an alternate embodiment, however, the height of surface 51 may be greater or less then the preferred height.

Support cushion 50 is attached to back panel 32 of seatback cover 20 by any means known within the art such as, for exemplary purposes only, ties, buckles, hook-and-loop fastener or the like. First cushion fastener 74 is attached to first end 54, and second cushion fastener 76 is attached to second end 56, preferably by glue, stitching or any known means within the art. First cushion fastener 74 and second cushion fastener 76 preferably comprise hook-and-loop fastener portions mating to those of first seatback fastener 70 and second seatback fastener 72, respectively, such that support cushion 50 is removably secured to seatback cover 20 when first cushion fastener 74 is mated with first seatback fastener 70 and second cushion fastener 76 is mated with second seatback fastener 72. Alternatively, ties, buttons, snaps or any known attaching means can be utilized to secure support cushion 50 to seatback cover 20.

In use, seatback cover 20 is slid over the seatback of the highchair A. Seatback cover 20 is secured by drawing fourth end 30 of front panel 22 and fourth end 40 of back panel 32 underneath the highchair A seatback and attaching first securing fastener 44 to second securing fastener 46. Support cushion 50 is placed on highchair A seat with first surface 51 oriented toward seatback cover 20, second surface 52 oriented toward the highchair A seat, and third surface 53 oriented toward the back of the child. Support cushion 50 is secured to seatback cover 20 when first cushion fastener 74 is attached to first seatback fastener 70 and second cushion fastener 76 is attached to second seatback fastener 72.

It should be noted that in an alternate embodiment, seatback cover 20 may be formed from a single sheet or blank of material. Although, washable cloth is the preferred material for seatback cover 20, other materials such as, for exemplary purposes only, plastics, leather or rubber may be utilized. It should also be noted that the dimensions of seatback 20 and support cushion 50 may be varied, as needed, depending on the dimensions of highchair A, the size of the child or the capabilities of the child.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

Having described my invention, I claim:

1. A highchair back support for use on a highchair having a seat, a seatback having a height, a width, a first side and a second side, said highchair back support comprising:

a seatback cover dimensioned to slide over the seatback of the highchair, the seatback cover having a front panel and a rear panel joined together to form a channel therebetween for receiving the seatback of the highchair, the front panel and the rear panel each having adjacent lower edges, the channel having a width greater than the width of the seat back, and a height at least as great as the height of the seatback;

a removable cushion support disposed on the seat of the highchair;

means for releasably connecting said cushion support to said seatback cover;

said connecting means including a first attachment member connected to and located adjacent the lower edges of the front and rear panels along said first side of the seat back, and connected to the cushion support;

a second attachment member connected to and located adjacent the lower edges of the front and rear panels along said second side of the seatback, and connected to the cushion support;

a third attachment member attached to and adjacent the lower edges of the first and second panels in a position between the first and second attachment members and under the seatback; and wherein said cushion support is positionable on the high chair seat between the seatback of the highchair and a child.

2. The highchair back support of claim 1, wherein said cushion support is foam.

3. The highchair back support of claim 1, further comprising a cover carried over said cushion support.

4. The highchair back support claim 1, wherein said cushion support is elongated and triangular shaped.

5. The highchair back support of claim 1, wherein said connecting means includes hook-and-loop fasteners.

6. The highchair back support of claim 1, wherein said connecting means includes at least one button.

7. The highchair back support of claim 1, wherein said connecting means includes at least one snap.

8. The highchair back support of claim 1, wherein said connecting means includes at least one tie.

9. The high chair back support of claim 1, wherein said connecting means includes at least one buckle.

* * * * *